US007971310B2

(12) United States Patent
Metaxatos et al.

(10) Patent No.: US 7,971,310 B2
(45) Date of Patent: Jul. 5, 2011

(54) CLEANING TOOL

(75) Inventors: Paul Metaxatos, Swampscott, MA (US); Eric Perlman, Weymouth, MA (US); Ryan Scribner, Cambridge, MA (US); Kurt Maclaurin, Arlington, MA (US)

(73) Assignee: Cobra Products, Inc., Bridgeport, NJ (US)

( * ) Notice: Subject to any disclaimer, the term of this patent is extended or adjusted under 35 U.S.C. 154(b) by 196 days.

(21) Appl. No.: 12/419,568

(22) Filed: Apr. 7, 2009

(65) Prior Publication Data

US 2010/0251498 A1 Oct. 7, 2010

(51) Int. Cl.
*A46B 17/06* (2006.01)

(52) U.S. Cl. ..... 15/105; 15/142; 15/246; 132/119; 132/155

(58) Field of Classification Search ..... 15/104.5, 15/105, 142, 246; 132/119, 155
See application file for complete search history.

(56) References Cited

U.S. PATENT DOCUMENTS

| | | | | | |
|---|---|---|---|---|---|
| 421,117 | A | * | 2/1890 | Voltz | 403/23 |
| 787,201 | A | * | 4/1905 | Martucci | 15/142 |
| 930,678 | A | * | 8/1909 | Moore | 132/126 |
| 1,138,244 | A | | 5/1915 | Parker | |
| 1,183,528 | A | * | 5/1916 | Bongiovanni | 15/142 |
| 1,185,732 | A | | 6/1916 | Swayne | |
| 1,220,105 | A | * | 3/1917 | Hart | 132/129 |
| 1,468,219 | A | | 9/1923 | Snazelle et al. | |
| 1,572,411 | A | * | 2/1926 | Schweizer | 132/119 |
| 2,606,050 | A | | 8/1952 | Morris et al. | |
| 2,779,259 | A | | 1/1957 | Kelsey | |
| 2,866,212 | A | | 12/1958 | White et al. | |
| 3,136,372 | A | | 6/1964 | Roach | |
| 3,293,680 | A | | 12/1966 | Wilson et al. | |
| 3,358,314 | A | * | 12/1967 | Matibag | 15/246 |
| 3,407,424 | A | | 10/1968 | Lanzarone et al. | |
| 3,444,934 | A | | 5/1969 | Alberto | |
| D223,945 | S | | 6/1972 | Bousquet | |
| 4,794,663 | A | | 1/1989 | Vosbikian | |
| 5,033,155 | A | | 7/1991 | Klotz | |
| 5,511,269 | A | | 4/1996 | Watson | |
| 5,802,657 | A | * | 9/1998 | Nogues et al. | 15/142 |
| 5,817,758 | A | * | 10/1998 | Lyttle et al. | 506/32 |
| 5,819,354 | A | | 10/1998 | Alonso et al. | |
| 6,520,672 | B1 | | 2/2003 | Whitney | |
| 6,722,444 | B2 | | 4/2004 | McKill | |
| 6,779,220 | B1 | * | 8/2004 | Raffa | 15/142 |
| 2005/0172437 | A1 | | 8/2005 | Wachter | |
| 2008/0047085 | A1 | | 2/2008 | Kolarevic et al. | |
| 2008/0109974 | A1 | * | 5/2008 | Cavalheiro | 15/105 |

FOREIGN PATENT DOCUMENTS

| | | | |
|---|---|---|---|
| EP | 0246712 | | 11/1987 |
| JP | 2000-14453 | * | 1/2000 |
| JP | 2006-102438 | * | 4/2006 |

* cited by examiner

*Primary Examiner* — Mark Spisich
(74) *Attorney, Agent, or Firm* — Carlson, Gaskey & Olds PC

(57) ABSTRACT

An implement mounted on a shaft has a device that either collects or has on it during or after use unwanted matter. The implement has a portion that is easily removable from the shaft and has a section creating at least a partial interference fit with the device to remove the unwanted matter therefrom.

8 Claims, 2 Drawing Sheets

CLEANING TOOL

BACKGROUND OF THE INVENTION

Brushes are known to have a telescoping handle for cleaning radiators, flooring, tile, hollow bodies and other dusty surfaces.

SUMMARY OF THE INVENTION

An implement mounted on a shaft has a device that either collects or has on it during or after use unwanted matter. The implement has a portion that is easily removable from the shaft and has a section creating at least a partial interference fit with the device to remove the unwanted matter therefrom.

According to an embodiment of the invention, the handle is slidably and rotatably disposed on a shaft of the tool whereby the handle aids a user in steadying or leveraging a brush attached to the shaft while cleaning.

According to another embodiment of the invention, the shaft of the tool is hollow thereby allowing a brush and a shaft that fits within the tool shaft to extend from a first position to an infinitely variable second position making it easier for the user to reach hard to reach places.

According to a further embodiment of the invention, the handle may have a set of interchangeable inserts that are disposed within the handle openings for use with different brushes or for different applications.

Other intentions and a fuller understanding of the invention will be had by referring to the following description and claims of a preferred embodiment thereof, taken in conjunction with the accompanying drawings described hereinbelow;

DETAILED DESCRIPTION OF THE PREFERRED EMBODIMENT

Figure 1:
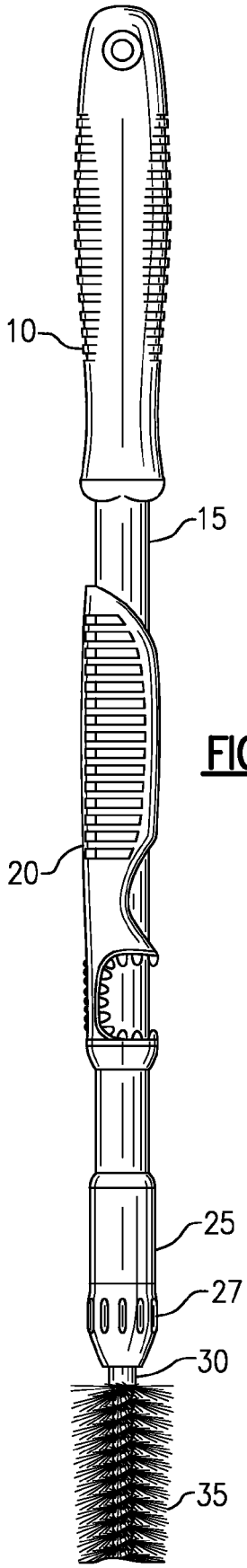
FIG. 1 illustrates a lint cleaning tool in accordance with the first embodiment of the invention.

Referring to FIG. 1, the apparatus of the invention is shown. The apparatus comprises a haft 10, a shaft 15 fixedly attached to the haft 10, a coupling 25 fixedly attached to the shaft 15, the coupling having a plurality of fingers (not shown) that are compressed or loosened by screwable nut 27 to allow shaft 30 to telescope within shaft 15 from a first position to any second position while residing therein and a brush 35 attached to the shaft 30. The coupling described herein is known in the art and any coupling that will allow the shaft 30 to adjustably telescopically within shaft 15 would be suitable for use herein.

Figure 7:
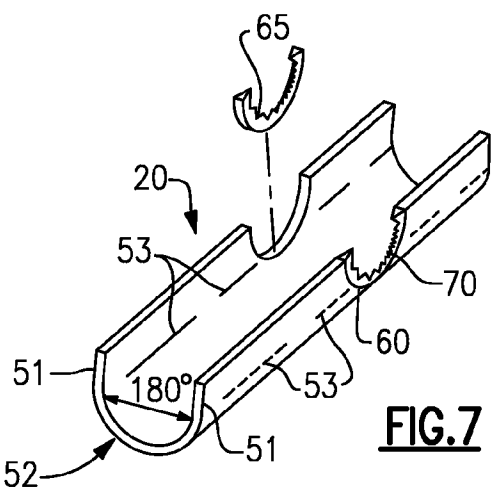
FIG. 7 shows a plan view of the handle of FIG. 1.
Figure 2:
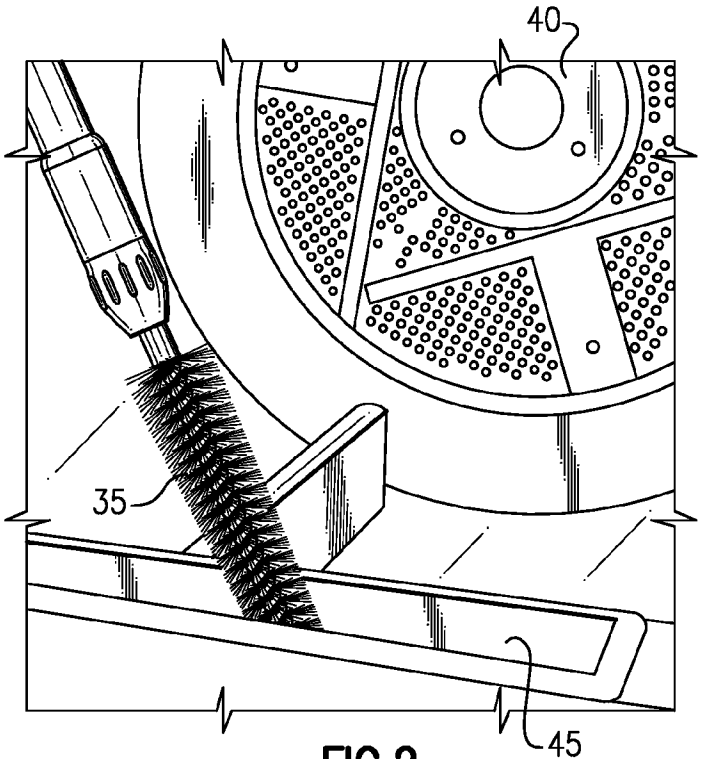
FIG. 2 shows the brush of FIG. 1 in use.

Referring to FIG. 2, the apparatus is shown in use with the brush 35 removing lint (not shown) from the lint trap 45 of a dryer 40. One will appreciate as will be discussed herein that the apparatus has other uses and applications Referring to FIG. 7 a perspective view of handle 20 is shown. The handle has a pair of side walls 51, a u-shaped section 52 connecting the walls whereby the walls and the section partially encircle the shaft 15 but are not so constricting to allow relative motion longitudinally and latitudinally between the shaft and the handle. The u-shaped section 52 defines a circular portion that is equal to or less than 180° so that the walls and the section 52 do not restrict removal or relative motion between the handle from the shaft. Each wall has a pair of longitudinal detents 53 opposing each other pair on the other wall that act to rotatably and slidingly maintain the shaft within the handle 15. Each wall has a set of indents 50 (see FIG. 3) to enhance a user's ability to grip the handle The handle 20 is constructed of polypropylene or other flexible, relatively strong plastic that allows repeated flexure of the walls 51 to move the detents 53 away from the detents on the other wall thereby enabling the handle to be either attached to or removed from the shaft 15.

Each side wall 51 has a transverse groove 60 disposed laterally to the length of the u-shaped section 52. The transverse groove has a plurality of teeth 65 disposed integrally within each groove 60 or within a removeable insert 70 to enable the tool to efficiently remove matter that does not belong within or on the brush 35. The shape of the groove 60 (and its related insert 65) is designed to create at least a partial interference fit with the brush 35 so that cleaning the brush by relative motion between the brush in the handle groove and the handle effectively removes matter that does not belong in or on the brush. One of ordinary skill in the art will recognize that the groove will have different shapes and different materials or non-planar protrusions to remove different matter encountered in using such a tool or if the brush in the tool has different characteristics. For instance, the groove may have a rubber insert if the handle is disposed on a paint brush or roller, or it may have deeper teeth if pet hair is to be removed from the brush, or it may have smaller rounded teeth if the brush may be easily damaged, or it may have an insert with metal teeth if the brush is metallic for rougher usage, or it may be shaped for a different cleaning tool other than a brush like a mop etc.

Figure 3:
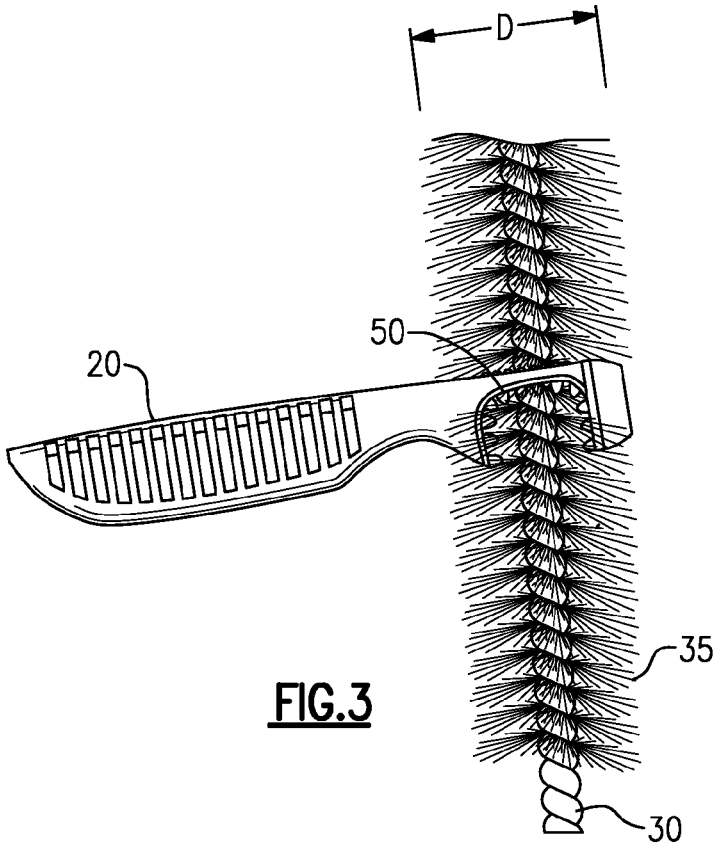
FIG. 3 shows the handle of FIG. 1 being used to clean the brush thereof.
Figure 5:
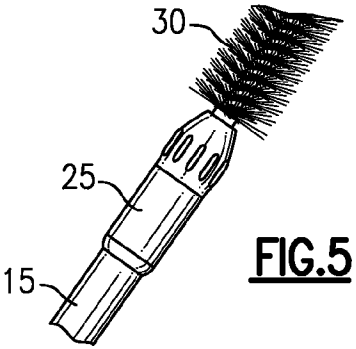
FIG. 5 shows the use of the brush of FIG. 1 in a second telescoped configuration.
Figure 4:
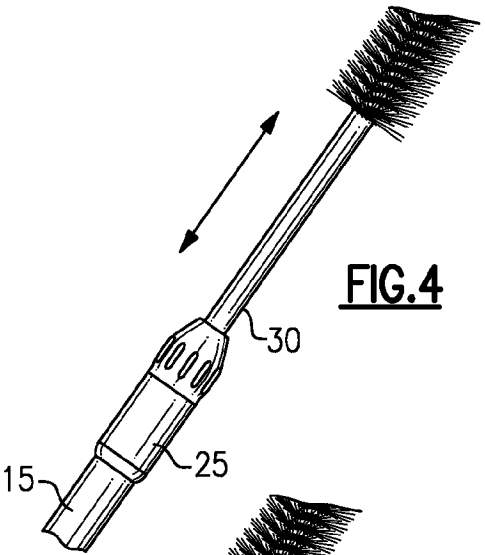
FIG. 4 shows the use of the brush of FIG. 1 in a telescoped configuration.
Figure 6:
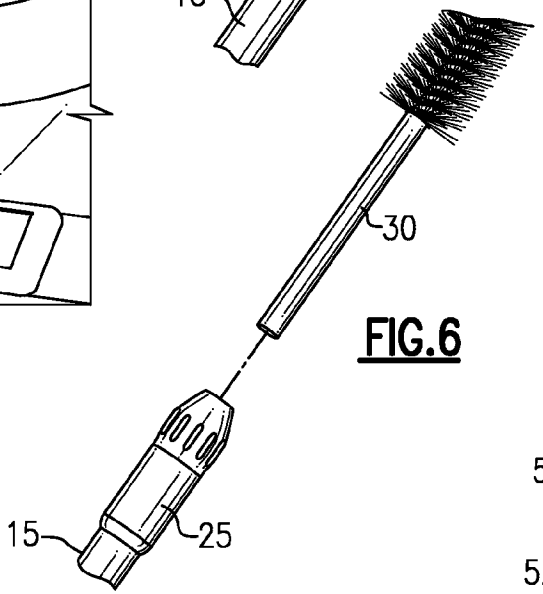
FIG. 6 shows the insertion of a tool into the shaft.

Referring now to FIG. 3, handle 20 is shown removed from its position on shaft 15 and forming an interference fit with the brush 35 which has an exterior dimension, width D. Relative motion between the brush within the groove 60 and the handle allows lint to be removed from the brush. The teeth 65 dig deeper into the brush and form an interference fit with width D to remove imbedded matter (not shown).

To use the tool, a user will first determine the proper length the tool should have to clean or remove unwanted matter from a chosen surface and then telescope the shaft 30 within shaft 15 using coupling 25 to achieve the appropriate length. The user then grips the haft 10 with one hand and the handle 20 with another hand and applies the brush 35 to that surface such as the lint trap shown if FIG. 2. To adjust for changed lengths of the tool or to gain the appropriate leverage, a user allows the handle 20 to slide along the length of shaft 15 as is appropriate. A user may also choose to rotate the brush at the particular removal site for more efficient cleaning by rotating the haft while the shaft 15 (and the brush 35 and the shaft 30 rotate therewith) rotates in the relatively motionless handle.

It is therefore to be understood that numerous modifications may be made to the illustrative embodiments and that other arrangements may be devised without departing from the spirit and scope of the present invention as defined by the appended claims. Although an embodiment of this invention has been disclosed, a worker of ordinary skill in this art would recognize that certain modifications would come within the scope of this invention. For that reason, the following claims should be studied to determine the true scope and content of this invention.

What is claimed is:

1. An apparatus for removing unwanted matter from a tool having a shaft and an unwanted matter device, said unwanted matter device having an exterior dimension, said apparatus comprising:

a portion having a u-shaped cross-section and a first leg attaching to a first side of said u-shaped cross section and a second leg attaching to a second side of said u-shaped section wherein said first leg, said second leg and said u-shaped section for attaching to said shaft such that said portion may be readily removed from or attached to said shaft, and a groove disposed in said first leg and said second leg of said portion transversely to said shaft, said groove in said first leg and said second leg creating at least a partial interference fit with the exterior dimension of said unwanted matter device to remove said unwanted matter therefrom.

2. The apparatus of claim 1 wherein said portion further comprises:

a dimension for allowing said portion to slide along said shaft if attached thereto.

3. The apparatus of claim 2 wherein said portion further comprises:

said dimension also allowing said portion to rotate relatively about said shaft if attached thereto.

4. The apparatus of claim 1 wherein said section of said portion further comprises:

an insert disposed in said groove for removing unwanted matter from associated tools.

5. An apparatus for removing unwanted matter, said apparatus comprising:

a shaft holding a unwanted matter tool, a handle removably disposed upon said shaft, said handle a portion having a u-shaped cross-section and a first leg attaching to a first side of said u-shaped cross section and a second leg attaching to a second side of said u-shaped section wherein said first leg, said second leg and said u-shaped section attaching to said shaft such that said portion may be readily removed from or attached to said shaft, and a groove disposed in said first leg and said second leg of said portion disposed transversely to said shaft, said groove creating at least a partial interference fit with the exterior dimension of said unwanted matter tool to remove said unwanted matter therefrom.

6. The apparatus of claim 5 wherein said handle is rotatably and slidably disposed on said shaft to allow a user to slide and rotate the handle relative to the shaft.

7. The apparatus of claim 5 wherein said groove of said handle further includes an insert for removing unwanted matter from said unwanted matter tool.

8. The apparatus of claim 5 wherein said unwanted matter tool is a brush.

* * * * *